US009187966B2

(12) United States Patent
Kulkarni et al.

(10) Patent No.: US 9,187,966 B2
(45) Date of Patent: Nov. 17, 2015

(54) DRILLING A WELL WITH PREDICTING SAGGED FLUID COMPOSITION AND MUD WEIGHT

(71) Applicant: HALLIBURTON ENERGY SERVICES, INC., Houston, TX (US)

(72) Inventors: Sandeep D. Kulkarni, Kingwood, TX (US); Kushabhau D. Teke, Pune (IN); Sharath Savari, Kingwood, TX (US); Dale E. Jamison, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 31 days.

(21) Appl. No.: 13/745,944

(22) Filed: Jan. 21, 2013

(65) Prior Publication Data

US 2014/0202772 A1 Jul. 24, 2014

(51) Int. Cl.
*E21B 7/04* (2006.01)
*E21B 21/08* (2006.01)

(52) U.S. Cl.
CPC ..... *E21B 21/08* (2013.01)

(58) Field of Classification Search
USPC ..... 702/11
See application file for complete search history.

(56) References Cited

U.S. PATENT DOCUMENTS 6,330,826 B1 12/2001 Meeten
6,584,833 B1 7/2003 Jamison et al.
6,931,916 B2 8/2005 Zamora et al.
7,870,782 B2 1/2011 Tehrani et al.
7,950,472 B2 5/2011 Difoggio et al.
8,024,962 B2 9/2011 Tonmukayakul et al.
8,575,541 B1 * 11/2013 Jamison et al. ..... 250/253
2004/0220742 A1 11/2004 Mese et al.
2008/0190190 A1 8/2008 Tan et al.
2008/0217065 A1 * 9/2008 McCosh ..... 175/66
2009/0126994 A1 5/2009 Tibbitts et al.
2010/0206063 A1 8/2010 Fujisawa et al.
2011/0167901 A1 7/2011 Jamison et al.
2011/0219856 A1 9/2011 Tonmukayakul et al.

OTHER PUBLICATIONS

V. Tirtaatmadja, P.H.T. Uhlherr & T. Sridhar, "Creeping Motion of Spheres in Fluid M1," Journal of Non-Newtonian Fluid Mechanics, 35 (1990), pp. 327-337.

Arild Sassen, "Sag of Weight Materials in Oil Based Drilling Fluids," IADC/SPE 77190, IADC/SPE Asia Pacific Drilling Technology, Copyright 2002, Jakarta, Indonesia, Sep. 9-11, 2002, 7 pages.

Paul D. Scott, Mario Zamora & Catalin Aldea, "Barite-Sag Management: Challenges, Strategies, Opportunities," IADC/SPE 87136, IADC/SPE Drilling Conference, Copyright 2004, Dallas, Texas, USA, Mar. 2-4, 2004, 11 pages.

(Continued)

*Primary Examiner* — Tung S Lau
(74) *Attorney, Agent, or Firm* — Holly Soehnge; Baker Botts L.L.P.

(57) ABSTRACT

Methods of drilling or treating a well including the steps of: designing a fluid with high-gravity solids (e.g., barite); calculating the sagged fluid mud weight after allowing for sag according to formulas; forming a fluid according to the sagged fluid mud weight; and introducing the fluid into the well. The methods can be used to help control the well or to avoid excessive drilling torque or pressure, kick, or lost circulation due to sag of high-gravity solids such as barite.

21 Claims, 3 Drawing Sheets

(56) References Cited

OTHER PUBLICATIONS

P A Bern, M Zamora, K S Slater & P J Hearn, "The Influence of Drilling Variables on Barite Sag," SPE 36670, 1996 SPE Annual Technical Conference and Exhibition, Copyright 1996,Denver, Colorado, USA, Oct. 6-9, 1996, 8 pages.
P A Bern, M Zamora, A T Hemphill, D Marshall, Baker Hughes, D Beardmore, T H Omland & E K Morton, "Field Monitoring of Weight-Material Sag," AADE-2010-DF-HO-25, 2010 AADE Fluids Conference and Exhibition, Copyright 2010, Houston, Texas, USA, Apr. 6-7, 2010, 12 pages.
R. Murphy, D. Jamison, T. Hemphill, S. Bell & C. Albrecht, "Apparatus for Measuring the Dynamic Solids-Settling Rates in Drilling Fluids," SPE 103088, 2006 SPE Annual Technical Conference and Exhibition, Copyright 2006, San Antonio, Texas, USA, Sep. 24-27, 2008, 9 pages.
Robert Murphy, Dale Jamison, Terry Hemphill, Stephen Bell & Carl Albrecht, "Measuring and Predicting Dynamic Sag," SPE 103088, 2006 SPE Annual Technical Conference and Exhibition, Copyright 2008, San Antonio, Texas, Sep. 24-27, 2006, pp. 142-149.
D.D. Atapattu, R.P. Chhabra & P.H.T Uhlerr, "Creeping Sphere Motion in Herschel-Bulkley Fluids: Flow Field and Drag," Journal of Non-Newtonian Fluid Mechanics, 59 (1995), pp. 245-265.
M.J. Solomon & S.J. Muller, "Flow Past a Sphere in Polystyrene-Based Boger Fluids: The Effect on the Coefficient of Finite Extensibility, Solvent Quality and Polymer Molecular Weight," Journal of Non-Newtonian Fluid Mechanics, 62 (1996), pp. 81-94.
N. Tonmukayakul, J.E. Bryant, M.S. Talbot & J.F. Morris, "Dynamic and Steady Shear Properties of Reversibly Cross-Linked Guar Solutions and Their Effects on Particle Settling Behavior," The XVth International Congress on Rheology, The Society of Rheology 80th Annual Meeting, American Institute of Physics, Copyright 2008, pp. 791-794.
Renzo Di Felice, D. De Kee & R.P. Chhabra, "Transport Processes in Bubbles, Drops and Particles: Chapter 9—Sedimentation and Fluidization of Solid Particles in Liquids," 2nd edition, copyright 2002, 5 pages.
R.P. Chhabra, "Bubbles, Drops and Particles in Non-Newtonian Fluids," Taylor & Francis Group LLC, Copyright 2007, 16 pages.
R. Byron Bird, Warren E. Stewart & Edwin N. Lightfoot, "Transport Phenomena," Copyright 1960, John Wiley & Sons, 5 pages.
P.M. Hanson, T.K. Trigg Jr., G. Rachal & M. Zamora, "Investigation of Barite "Sag" in Weighted Drilling Fluids in Highly Deviated Wells," SPE 20423, 66th Annual Technical Conference and Exhibition of the Society of Petroleum Engineers, Copyright 1990, New Orleans, Louisiana, Sep. 23-26, 1990, pp. 223-330.
P.R. Paslay, U.B. Sathuvalli & M.L. Payne, "A phenomenological Approach to Analysis of Barite Sag in Drilling Muds," SPE 110404, 2007 SPE Annual Technical Conference and Exhibition, Copyright 2007, Anaheim, California, Nov. 11-14, 2007, 11 pages.
D.E Jamison & W.R. Clements, "A New Test Method to Characterize Setting/SAG Tendencies of Drilling Fluids Used in Extended Reach Drilling," ASME 1990 Drilling Tech. Symp., Barold Drilling Fluids, Inc. Houston, Texas, pp. 109-113
D.T. Jefferson, "New Procedure Helps Monitor Sag in the Field," Energy-Sources Technology Conference and Exhibition, New Orleans, Louisiana, Jan. 20-24, 1991, 7 pages.
A.A. Campbell Swinton, "Power From the Sun," Jan. 20, 1920, Nature Publishing Group, Copyright 192, p. 532.
A.E. Boycott, "Sedimemtation of Blood Corpuscles," Nature, 104, 1920, p. 532.
International Preliminary Report on Patentability issued in related PCT Application No. PCT/US2013/073237, mailed Jul. 30, 2015 (6 pages).

* cited by examiner

***MW^s* to help manage or control a well during a well servicing operation**

DRILLING A WELL WITH PREDICTING SAGGED FLUID COMPOSITION AND MUD WEIGHT

CROSS-REFERENCE TO RELATED APPLICATIONS

Not applicable.

TECHNICAL FIELD

The inventions are in the field of producing crude oil or natural gas from subterranean formations. More specifically, the inventions generally relate to methods of drilling a well with predicting particulate weighting material sag in drilling and other fluids that are weighted with particulate weighting material such as barite, hematite, iron oxide, manganese tetroxide, galena, magnetite, lilmenite, siderite, celesite, or any combination thereof. Such methods can be used, for example, in maintaining well control during drilling a well.

BACKGROUND

Generally, well services include a wide variety of operations that may be performed in oil, gas, geothermal, or water wells, such as drilling, cementing, completion, and intervention. Well services are designed to facilitate or enhance the production of desirable fluids such as oil or gas from or through a subterranean formation. A well service usually involves introducing a fluid into a well.

Drilling is the process of drilling the wellbore. After a portion of the wellbore is drilled, sections of steel pipe, referred to as casing, which are slightly smaller in diameter than the borehole, are placed in at least the uppermost portions of the wellbore. The casing provides structural integrity to the newly drilled borehole.

The well is created by drilling a hole into the earth (or seabed) with a drilling rig that rotates a drill string with a drilling bit attached to the downward end. Usually the borehole is anywhere between about 5 inches (13 cm) to about 36 inches (91 cm) in diameter. As upper portions are cased or lined, progressively smaller drilling strings and bits must be used to pass through the uphole casings or liners, which steps the borehole down to progressively smaller diameters.

While drilling an oil or gas well, a drilling fluid is circulated downhole through a drillpipe to a drill bit at the downhole end, out through the drill bit into the wellbore, and then back uphole to the surface through the annular path between the tubular drillpipe and the borehole. The purpose of the drilling fluid is to lubricate the drill string, maintain hydrostatic pressure in the wellbore, and carry rock cuttings out from the wellbore.

The drilling fluid can be water-based or oil-based. Oil-based fluids tend to have better lubricating properties than water-based fluids, nevertheless, other factors can mitigate in favor of using a water-based drilling fluid.

In addition, the drilling fluid may be viscosified to help suspend and carry rock cuttings out from the wellbore. Rock cuttings can range in size from silt-sized particles to chunks measured in centimeters. Carrying capacity refers to the ability of a circulating drilling fluid to transport rock cuttings out of a wellbore. Other terms for carrying capacity include hole-cleaning capacity and cuttings lifting.

Both the dissolved solids and the undissolved solids can be chosen to help increase the density of the drilling fluid. An example of an undissolved weighting agent is barite (barium sulfate). The density of a drilling mud can be much higher than that of typical seawater or even higher than high-density brines due to the presence of suspended solids. The weight of pure water is about 8.3 ppg (990 g/l), whereas mud weights can range from about 6 ppg (720 g/l) to about 22 ppg (2600 g/l).

Sag of particulate weighting material, such as barite sag, has been a poorly understood phenomenon, especially in oil-based muds ("OBM"). Oil-based muds are typically used in moderate and high pressure and temperature environments. Sag may cause unwanted density variations in the circulating fluid, leading to well-stability or well-control issues. Sag is also of concern in highly deviated, directional and ERD (extended reach drilling) wells, and experiments have shown that the greatest influences of sag occur at well bore inclinations from 20° to 60° to the horizontal.

The large density variations created by sag can create wellbore management problems, and can even result in wellbore failure. Additionally, fluid sag can lead to sticking of drill pipe, difficulty in re-initiating or maintaining proper circulation of the fluid, possible loss of circulation and disproportionate removal from the well of lighter components of the fluid.

The issue becomes severe for highly deviated and complex wells. The ability to predict sagged fluid mud weight would be a crucial step in determining changes in torque, pump pressures, and bottom hole pressure excursions when flow is restarted due to a sag event.

SUMMARY OF THE INVENTION

There has been a need for experimental and empirical methods to understand sag of high-gravity solids for different fluid compositions and in various well environments and under various flow conditions in a well. The determination of a dynamic mud-weight profile in a wellbore, especially a sagged fluid mud weight, is crucial as it could help to understand and avoid excessive drilling torque or pressure, kick, or lost circulation due to sag.

In an embodiment according to the invention, a method of managing or controlling a drilling operation in a well is provided, the method comprising the steps of:

(A) obtaining composition and initially uniform mud weight of a drilling fluid;

(B) obtaining wellbore flow conditions in the well operation, including trip-in and trip-out timings, rate of drill pipe rotation, and drilling fluid circulation rate;

(C) estimating an initial equivalent circulation density for the drilling fluid based on the initial uniform mud weight of the drilling fluid;

(D) estimating or experimentally determining a sagged fluid mud weight ($MW^s$) for the drilling fluid;

(E) re-evaluating a later equivalent circulation density based on the estimated $MW^s$; and (F) modifying the drilling fluid or the wellbore flow conditions to manage or control the well or avoid an equivalent circulation density difference greater than 0.05 ppg in the well, or preferably to avoid an equivalent circulation density greater than 0.1 ppg.

In another embodiment according to the invention, a method of drilling or treating a portion of a well is provided, the method comprising the steps of:

(A) designing or obtaining a fluid comprising the following components:

(i) a continuous oil phase;

(ii) an internal water phase;

(iii) one or more high-gravity solids in particulate form, wherein the high-gravity solids are insoluble in both the oil phase and the water phase; and optionally (iv) one or more low-gravity solids in particulate form, wherein the low-gravity solids are insoluble in both the oil phase and the water phase;

(B) determining:

$$MW^i=\Sigma\rho_j^i*\phi_j^i$$

where $MW^i$ is the mud weight of the fluid when it is initially uniform;

where $\rho_j^i$ is the density of each of the components of the fluid when it is initially uniform; and where $\phi_j^i$ is the volume fraction of each of the components of the fluid when it is initially uniform;

(C) predicting a sagged fluid mud weight of a sagged portion of the fluid as:

$$MW^s=\Sigma\rho_j^s*\phi_j^s$$

where $MW^s$ is the sagged fluid mud weight of a sagged portion of the fluid after allowing time for sag in the fluid of the high-gravity solids when the fluid is under conditions of low shear or no shear;

where $\rho_j^s$ for each of the components of the sagged portion is selected to be adjusted for a design temperature and pressure in the portion of the well, or where $\rho_j^s$ for each of the components of the sagged portion selected to be within about 30% of the $\rho_j^i$ of each of the components of the fluid, respectively, or preferably wherein where $\rho_j^s$ for each of the components of the sagged portion is selected to be anywhere within about 20% of the $\rho_j^i$ of each of the component of the fluid, respectively, or still more preferably wherein where $\rho_j^s$ for each of the components of the sagged portion is selected to be about equal to the $\rho_j^i$ of each of the component of the fluid (in which case, the density of the individual components is selected as not changing);

where $\phi_j^s$ is the volume fraction of each of the components of the sagged portion, wherein:

the ratio of $\phi_j^s$ for each of the high-gravity solids to $\phi_j^s$ for the water phase is selected to be within 20% of the ratio of $\phi_j^i$ for each of the high-gravity solids to $\phi_j^i$ for the water phase, respectively, or preferably the ratio of $\phi_j^s$ for each of the high-gravity solids to $\phi_j^s$ for the water phase is selected to be about equal to the ratio of $\phi_j^i$ for each of the high-gravity solids to $\phi_j^i$ for the water phase, respectively;

$\phi_j^s$ for each of the low-gravity solids is selected to be anywhere in the range of zero to 2 times $\phi_j^i$ for each of the low-gravity solids, respectively, or preferably $\phi_j^s$ for each of the low-gravity solids is selected to be anywhere in the range of 0.8 to 1.2 times of $\phi_j^i$ each of the low-gravity solids, or more preferably $\phi_j^s$ for each of the low-gravity solids is selected to be about equal to $\phi_j^i$ for each of the low-gravity solids;

the sum of $\phi_j^s$ for the water phase, $\phi_j^s$ for each of the high-gravity solids, and $\phi_j^s$ for each of the low-gravity solids is selected to be anywhere in the range of 0.5 to 0.75, or preferably the sum is selected to be anywhere in the range of 0.60 to 0.70, or more preferably the sum is selected to be anywhere in the range of 0.63 to 0.68; and the $\phi_j^s$ for the oil phase is selected to be the balance of the volume fraction of the sagged portion;

(D) designing or obtaining wellbore flow conditions in the well;

(E) determining whether the $MW^s$ is sufficient for control of the well or is sufficient for avoiding an equivalent circulation density difference greater than 0.05 ppg in the well, or preferably avoiding an equivalent circulation density difference greater than 0.05 ppg in the well, or preferably to avoid an equivalent circulation density greater than 0.1 ppg;

(F) modifying the fluid or flow conditions to control the well or avoid the equivalent circulation density difference greater than 0.0.5 ppg in the well, or preferably to avoid an equivalent circulation density greater than 0.1 ppg; and (G) flowing the fluid in the well.

In an embodiment of the methods, the methods further include the step of circulating the fluid downhole in the well under conditions of low shear, where sag in the fluid is likely to occur. As used herein, conditions of low shear are a circulation rate of less than 100 ft/min or drill pipe rotation speed less than 100 RPM anywhere in the wellbore for at least about 1 hour.

These and other aspects of the invention will be apparent to one skilled in the art upon reading the following detailed description. While the invention is susceptible to various modifications and alternative forms, specific embodiments thereof will be described in detail and shown by way of example. It should be understood, however, that it is not intended to limit the invention to the particular forms disclosed, but, on the contrary, the invention is to cover all modifications and alternatives falling within the spirit and scope of the invention as expressed in the appended claims.

BRIEF DESCRIPTION OF THE DRAWING

The accompanying drawing is incorporated into the specification to help illustrate examples according to the presently most-preferred embodiment of the invention. It should be understood that the figures of the drawing are not necessarily to scale.

FIG. 1(*b*) is a simplistic schematic of a sagged fluid scenario in the same wellbore showing possibilities for a section with an initially-uniform fluid having the initially-uniform fluid mud density ($MW^i$), a depleted mud section having a depleted fluid mud weight ($MW^d$), and a sagged mud section having a sagged fluid mud weight ($MW^s$).

DEFINITIONS AND USAGES

Interpretation

Figure 1A:
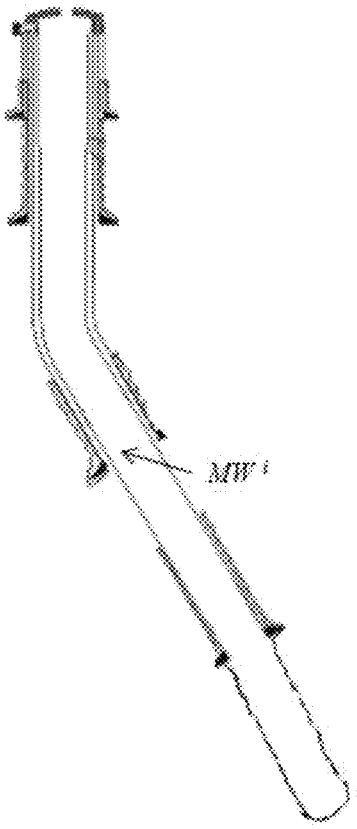
FIG. 1(*a*) is a simplistic schematic of a fluid having an initially uniform fluid density (mud weight $MW^i$) in a wellbore.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The words "comprising," "containing," "including," "having," and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed.

The indefinite articles "a" or "an" mean one or more than one of the component, part, or step that the article introduces.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

It should be understood that the various algebraic variables used herein are selected arbitrarily or according to convention. Other algebraic variables can be used instead.

Oil and Gas Reservoirs

In the context of production from a well, however, "oil" and "gas" are understood to refer to crude oil and natural gas, respectively. Oil and gas are naturally occurring hydrocarbons in certain subterranean formations.

A "subterranean formation" is a body of rock that has sufficiently distinctive characteristics and is sufficiently continuous for geologists to describe, map, and name it.

A subterranean formation containing oil or gas may be located under land or under the seabed off shore. Oil and gas reservoirs are typically located in the range of a few hundred feet (shallow reservoirs) to a few tens of thousands of feet (ultra-deep reservoirs) below the surface of the land or seabed.

Wells and Fluids

A "well" includes a wellhead and at least one wellbore from the wellhead penetrating the earth. The "wellhead" is the surface termination of a wellbore, which surface may be on land or on a seabed. A "well site" is the geographical location of a wellhead of a well. It may include related facilities, such as a tank battery, separators, compressor stations, heating or other equipment, and fluid pits. If offshore, a well site can include a platform.

The "wellbore" refers to the drilled hole, including any cased or uncased portions of the well or any other tubulars in the well. The "borehole" usually refers to the inside wellbore wall, that is, the rock surface or wall that bounds the drilled hole. A wellbore can have portions that are vertical, horizontal, or anything in between, and it can have portions that are straight, curved, or branched. As used herein, "uphole," "downhole," and similar terms are relative to the direction of the wellhead, regardless of whether a wellbore portion is vertical or horizontal.

As used herein, introducing "into a well" means introducing at least into and through the wellhead. According to various techniques known in the art, tubulars, equipment, tools, or fluids can be directed from the wellhead into any desired portion of the wellbore.

As used herein, the word "tubular" means any kind of body in the general form of a tube. Examples of tubulars include, but are not limited to, a drill pipe, a casing, a tubing string, a line pipe, and a transportation pipe. Tubulars can also be used to transport fluids such as fluids, oil, gas, water, liquefied methane, coolants, and heated fluids into or out of a subterranean formation.

As used herein, the term "annulus" means the space between two generally cylindrical objects, one inside the other. The objects can be concentric or eccentric. Without limitation, one of the objects can be a tubular and the other object can be an enclosed conduit. The enclosed conduit can be a wellbore or borehole or it can be another tubular. The following are some non-limiting examples illustrating some situations in which an annulus can exist. Referring to an oil, gas, or water well, in an open hole well, the space between the outside of a tubing string and the borehole of the wellbore is an annulus. In a cased hole, the space between the outside of the casing and the borehole is an annulus. In addition, in a cased hole there may be an annulus between the outside cylindrical portion of a tubular such as a production tubing string and the inside cylindrical portion of the casing. An annulus can be a space through which a fluid can flow or it can be filled with a material or object that blocks fluid flow, such as a packing element. Unless otherwise clear from the context, as used herein an annulus is a space through which a fluid can flow.

As used herein, a "fluid" can be, for example, a drilling fluid, a setting composition, a treatment fluid, or a spacer fluid.

As used herein, unless the context otherwise requires, the "weight" of a fluid or component of a fluid refers to the density of the fluid or component.

As used herein, the word "treatment" refers to any treatment for changing a condition of a portion of a wellbore or a subterranean formation adjacent a wellbore; however, the word "treatment" does not necessarily imply any particular treatment purpose. A treatment usually involves introducing a fluid for the treatment, in which case it may be referred to as a treatment fluid, into a well. As used herein, a "treatment fluid" is a fluid used in a treatment. The word "treatment" in the term "treatment fluid" does not necessarily imply any particular treatment or action by the fluid.

A zone refers to an interval of rock along a wellbore that is differentiated from uphole and downhole zones based on hydrocarbon content or other features, such as permeability, composition, perforations or other fluid communication with the wellbore, faults, or fractures. A zone of a wellbore that penetrates a hydrocarbon-bearing zone that is capable of producing hydrocarbon is referred to as a "production zone." A "treatment zone" refers to an interval of rock along a wellbore into which a fluid is directed to flow from the wellbore. As used herein, "into a treatment zone" means into and through the wellhead and, additionally, through the wellbore and into the treatment zone.

As used herein, a downhole fluid is an in-situ fluid in a well, which may be the same as a fluid at the time it is introduced, or a fluid mixed with another other fluid downhole, or a fluid in which chemical reactions are occurring or have occurred in-situ downhole.

Generally, the greater the depth of the formation, the higher the static temperature and pressure of the formation. Initially, the static pressure equals the initial pressure in the formation before production. After production begins, the static pressure approaches the average reservoir pressure.

Deviated wells are wellbores inclined at various angles to the vertical. Complex wells include inclined wellbores in high-temperature or high-pressure downhole conditions.

A "design" refers to the estimate or measure of one or more parameters planned or expected for a particular fluid or stage of a well service or treatment. For example, a fluid can be designed to have components that provide a minimum density or viscosity for at least a specified time under expected downhole conditions. A well service may include design parameters such as fluid volume to be pumped, required pumping time for a treatment, temperature, pressure, or the shear conditions of the pumping.

The term "design temperature" refers to an estimate or measurement of the actual temperature at the downhole environment at the time of a treatment. For example, the design temperature for a well treatment takes into account not only the bottom hole static temperature ("BHST"), but also the effect of the temperature of the fluid on the BHST during treatment. The design temperature for a fluid is sometimes referred to as the bottom hole circulation temperature ("BHCT"). Because fluids can be considerably cooler than BHST, the difference between the two temperatures can be quite large. Ultimately, if left undisturbed, a subterranean formation will return to the BHST.

The control or controlling of a condition includes any one or more of maintaining, applying, or varying of the condition. For example, controlling the temperature of a substance can include heating, cooling, or thermally insulating the substance.

Drilling and Drilling Muds

Drilling requires well control, which is maintaining pressure on open formations (that is, exposed to the wellbore) to prevent or direct the flow of formation fluids into the wellbore. This technology encompasses an estimation of formation fluid pressures, the strength of the subsurface formations, and the use of casing or mud density to offset those pressures in a predictable fashion. Well control also includes operational procedures to safely stop a well from flowing should an influx of formation fluid occur. To conduct well-control procedures, large valves are installed at the top of the well to enable closing the well if necessary.

Drilling fluids, also known as drilling muds or simply "muds," are typically classified according to their base fluid, that is, the nature of the continuous phase. A water-based mud ("WBM") has a water phase as the continuous phase. The water phase can be a brine. A brine-based drilling fluid is a water-based mud in which the aqueous component is brine. In some cases, oil may be emulsified in a water-based drilling mud. An oil-based mud ("OBM") has an oil phase as the continuous phase. In some cases, a water phase is emulsified in the oil-based mud.

A "bottom hole assembly" is the lower portion of a drill string, including at least a bit, stabilizers, a drill collar, jarring devices ("jars"), and at least one bottom hole tool selected from the group consisting of measurement while drilling ("MWD") tools and logging while drilling ("LWD") tools. For example, MWD tools include electromagnetic measurement while drilling ("EM/MWD") tools and seismic while drilling ("SWD") tools. The terms MWD and LWD are sometimes used interchangeably, but LWD is broadly directed to the process of obtaining information about the rock of the subterranean formation (porosity, resistivity, etc.), whereas MWD is broadly directed to the process or tools directed to obtaining information about the progress of the drilling operation (rate of penetration, weight on bit, wellbore trajectory for geo-steering, etc.).

"Sag" is settling of heavy-weight particulate (that is, high-density particulate) such as barite particles in the fluid, which can occur under low shear conditions. As used herein, "sag" means a density variation of a fluid that is greater than 0.1 ppg due to settling of high-gravity solids.

"Initially uniform fluid" or "initially uniform mud" is the initially-formed fluid or a portion of the initially-formed fluid having the same composition, phase distribution, and density as the initially-formed fluid. Mix with at least sufficient shear to form a uniformly dispersed fluid, preferably at least 300 rpm.

"Initially uniform fluid mud weight" ($MW^i$) is the fluid weight (density) of the initially-formed fluid.

"Sagged fluid" or "sagged mud" is the fluid portion heavier (higher density) than the initially uniform fluid; a "sagged fluid" is a portion of a fluid formed as a result of "sag" event.

"Sagged fluid mud weight" ($MW^s$) is the density of a "sagged fluid."

"Depleted fluid" or "depleted mud" is a portion of a fluid that is lighter (lower density) than the initial uniform fluid; a "depleted fluid" is a portion of a fluid formed as a result of "sag" event.

"Depleted fluid mud weight" ($MW^d$) is the density of a "depleted fluid."

"Sagged fluid packing" is the range of volume fractions that the one or more dispersed phases (liquid droplets or solid particles) can occupy when suspended in a fluid.

"Equivalent circulating density" ("ECD") at a point in the wellbore annulus is the effective fluid density experienced at that point that comprises of contribution from the intrinsic density of a fluid and a contribution from flow-induced pressure drop in an annulus above the point in a wellbore.

Drilling pressure corresponds to pump pressure, that is, the reading indicated by the pressure gauge situated close to the fluid pump.

Drilling torque corresponds to the drag experienced by the bottom hole assembly ("BHA") while drilling.

"Kick" is an influx of gas or fluid from the formation into the wellbore.

Excessive drilling torque or pressure, kick, or lost circulation can occur due to ECD variations in the drilling fluid, which may be the result of sag. A person of skill in the art will appreciate how to determine excessive drilling torque or pressure, kick, or lost circulation.

"Dynamic mud weight profile" is the profile of solids settling or sag progressing with time, the mud weight profile along the depth of wellbore column would keep changing with time; this time-dependent mud-weight profile along the length of the wellbore column is termed as "dynamic mud weight profile."

Physical States, Phases, and Materials

A substance can be a pure chemical or a mixture of two or more different chemicals.

The common physical states of matter or substances include solid, liquid, and gas.

As used herein, "phase" is used to refer to a substance having a chemical composition and physical state that is distinguishable from an adjacent phase of a substance having a different chemical composition or a different physical state.

The word "material" is anything made of matter, constituted of one or more phases. Rock, water, air, metal, cement slurry, sand, and wood are all examples of materials. The word "material" can refer to a single phase of a substance on a bulk scale (larger than a particle) or a bulk scale of a mixture of phases, depending on the context.

As used herein, if not other otherwise specifically stated, the physical state or phase of a substance (or mixture of substances) and other physical properties are determined at a temperature of 77° F. (25° C.) and a pressure of 1 atmosphere (Standard Laboratory Conditions) without applied shear.

Particles and Particulate

As used herein, a "particle" refers to a body having a finite mass and sufficient cohesion such that it can be considered as an entity but having relatively small dimensions. A particle can be of any size ranging from molecular scale to macroscopic, depending on context.

A particle can be in any physical state. For example, a particle of a substance in a solid state can be as small as a few molecules on the scale of nanometers up to a large particle on the scale of a few millimeters, such as large grains of sand.

Similarly, a particle of a substance in a liquid state can be as small as a few molecules on the scale of nanometers up to a large drop on the scale of a few millimeters. A particle of a substance in a gas state is a single atom or molecule that is separated from other atoms or molecules such that intermolecular attractions have relatively little effect on their respective motions.

As used herein, particulate or particulate material refers to matter in the physical form of distinct particles in a solid or liquid state (which means such an association of a few atoms or molecules). As used herein, a particulate is a grouping of particles having similar chemical composition and particle size ranges anywhere in the range of about 0.5 micrometer (500 nm), e.g., microscopic clay particles, to about 3 millimeters, e.g., large grains of sand.

A particulate can be of solid or liquid particles. As used herein, however, unless the context otherwise requires, particulate refers to a solid particulate. Of course, a solid particulate is a particulate of particles that are in the solid physical state, that is, the constituent atoms, ions, or molecules are sufficiently restricted in their relative movement to result in a fixed shape for each of the particles.

It should be understood that the terms "particle" and "particulate," includes all known shapes of particles including substantially rounded, spherical, oblong, ellipsoid, rod-like, fiber, polyhedral (such as cubic materials), etc., and mixtures thereof. For example, the term "particulate" as used herein is intended to include solid particles having the physical shape of platelets, shavings, flakes, ribbons, rods, strips, spheroids, toroids, pellets, tablets or any other physical shape.

As used herein, a fiber is a particle or grouping of particles having an aspect ratio L/D greater than 5/1.

A particulate will have a particle size distribution ("PSD"). As used herein, "the size" of a particulate can be determined by methods known to persons skilled in the art.

One way to measure the approximate particle size distribution of a solid particulate is with graded screens. A solid particulate material will pass through some specific mesh (that is, have a maximum size; larger pieces will not fit through this mesh) but will be retained by some specific tighter mesh (that is, a minimum size; pieces smaller than this will pass through the mesh). This type of description establishes a range of particle sizes. A "+" before the mesh size indicates the particles are retained by the sieve, while a "−" before the mesh size indicates the particles pass through the sieve. For example, −70/+140 means that 90% or more of the particles will have mesh sizes between the two values.

Particulate materials are sometimes described by a single mesh size, for example, 100 U.S. Standard mesh. If not otherwise stated, a reference to a single particle size means about the mid-point of the industry-accepted mesh size range for the particulate.

As used herein, "particle density" or "true density" means the density of a particulate is the density of the individual particles that make up the particulate, in contrast to the bulk density, which measures the average density of a large volume of the powder in a specific medium (usually air). The particle density is a relatively well-defined quantity, as it is not dependent on the degree of compaction of the solid, whereas the bulk density has different values depending on whether it is measured in the freely settled or compacted state (tap density). However, a variety of definitions of particle density are available, which differ in terms of whether pores are included in the particle volume, and whether voids are included. As used herein, particle density is the apparent density of a particle having any pores or voids into which water does not penetrate.

Dispersions

A dispersion is a system in which particles of a substance of one chemical composition and physical state are dispersed in another substance of a different chemical composition or physical state. In addition, phases can be nested. If a substance has more than one phase, the most external phase is referred to as the continuous phase of the substance as a whole, regardless of the number of different internal phases or nested phases.

A dispersion can be classified different ways, including, for example, based on the size of the dispersed particles, the uniformity or lack of uniformity of the dispersion, and, if a fluid, whether or not precipitation occurs.

A dispersion is considered to be heterogeneous if the dispersed particles are not dissolved and are greater than about 1 nanometer in size. (For reference, the diameter of a molecule of toluene is about 1 nm and a molecule of water is about 0.3 nm).

Heterogeneous dispersions can have gas, liquid, or solid as an external phase. For example, in a case where the dispersed-phase particles are liquid in an external phase that is another liquid, this kind of heterogeneous dispersion is more particularly referred to as an emulsion. A solid dispersed phase in a continuous liquid phase is referred to as a sol, suspension, or slurry, partly depending on the size of the dispersed solid particulate.

A dispersion is considered to be homogeneous if the dispersed particles are dissolved in solution or the particles are less than about 1 nanometer in size. Even if not dissolved, a dispersion is considered to be homogeneous if the dispersed particles are less than about 1 nanometer in size.

A solution is a special type of homogeneous mixture. A solution is considered homogeneous: (a) because the ratio of solute to solvent is the same throughout the solution; and (b) because solute will never settle out of solution, even under powerful centrifugation, which is due to intermolecular attraction between the solvent and the solute. An aqueous solution, for example, saltwater, is a homogenous solution in which water is the solvent and salt is the solute.

Solubility

A substance is considered to be "soluble" in a liquid if at least 10 grams of the substance can be dissolved in one liter of the liquid (which is at least 83 ppt) when tested at 77° F. and 1 atmosphere pressure for 2 hours, considered to be "insoluble" if less than 1 gram per liter (which is less than 8.3 ppt), and considered to be "sparingly soluble" for intermediate solubility values. If the liquid is not specified, the substance is considered to be soluble, sparingly soluble, or insoluble in both water and oil. For example, an "insoluble" solid means that the substance of the solid is not soluble in either water or oil.

As will be appreciated by a person of skill in the art, the hydratability, dispersibility, or solubility of a substance in water can be dependent on the salinity, pH, or other substances in the water. Accordingly, the salinity, pH, and additive selection of the water can be modified to facilitate the hydratability, dispersibility, or solubility of a substance in aqueous solution. To the extent not specified, the hydratability, dispersibility, or solubility of a substance in water is determined in deionized water, at neutral pH, and without any other additives.

As used herein, the term "polar" means having a dielectric constant greater than 30. The term "relatively polar" means having a dielectric constant greater than about 2 and less than about 30. "Non-polar" means having a dielectric constant less than 2.

Fluids

A fluid can be a single phase or a dispersion. In general, a fluid is an amorphous substance that is or has a continuous phase of particles that are smaller than about 1 micrometer that tends to flow and to conform to the outline of its container.

Examples of fluids are gases and liquids. A gas (in the sense of a physical state) refers to an amorphous substance that has a high tendency to disperse (at the molecular level) and a relatively high compressibility. A liquid refers to an amorphous substance that has little tendency to disperse (at the molecular level) and relatively high incompressibility. The tendency to disperse is related to Intermolecular Forces (also known as van der Waal's Forces). (A continuous mass of a particulate, e.g., a powder or sand, can tend to flow as a fluid depending on many factors such as particle size distribution, particle shape distribution, the proportion and nature of any wetting liquid or other surface coating on the particles, and many other variables. Nevertheless, as used herein, a fluid does not refer to a continuous mass of particulate as the sizes of the solid particles of a mass of a particulate are too large to be appreciably affected by the range of Intermolecular Forces.)

As used herein, a fluid is a substance that behaves as a fluid under Standard Laboratory Conditions, that is, at 77° F. (25° C.) temperature and 1 atmosphere pressure, and at the higher temperatures and pressures usually occurring in subterranean formations without applied shear.

Every fluid inherently has at least a continuous phase. A fluid can have more than one phase. The continuous phase of a fluid is a liquid under Standard Laboratory Conditions. For example, a fluid can be in the form of be a suspension (larger solid particles dispersed in a liquid phase), a sol (smaller solid particles dispersed in a liquid phase), an emulsion (liquid particles dispersed in another liquid phase), or a foam (a gas phase dispersed in a liquid phase).

As used herein, a water-based fluid means that water or an aqueous solution is the dominant material of the continuous phase, that is, greater than 50% by weight, of the continuous phase of the fluid based on the combined weight of water and any other solvents in the phase (that is, excluding the weight of any dissolved solids).

In contrast, "oil-based" means that oil is the dominant material by weight of the continuous phase of the fluid. In this context, the oil of an oil-based fluid can be any oil based on the combined weight of oil and any other solvents in the phase (that is, excluding the weight of any dissolved solids).

In the context of a fluid, "oil" is understood to refer to an oil liquid (sometimes referred to as an oleaginous liquid), whereas "gas" is understood to refer to a physical state of a substance, in contrast to a liquid. In this context, an oil is any substance that is liquid under Standard Laboratory Conditions, is hydrophobic, and soluble in organic solvents. Oils have a high carbon and hydrogen content and are non-polar. This general definition includes classes such as petrochemical oils, vegetable oils, and many organic solvents. All oils can be traced back to organic sources.

Oil is generally more compressible than water. For example, an oil can change density (at 400 F) changes from 0.67 g/cc to 0.84 g/cc when the applied pressure changes from atmospheric pressure to 30,000 psi. Thus, the change in density in this example is about 25%. The change in density would also be expected to also vary with temperature. In contrast, the change in water density is less than 3.5% as the pressure changes from atmospheric to 15,000 psi, and the change is just 8% as the pressure changes from atmospheric to 73,000 psi. Thus, water is much less compressible than oil. Compressibility curves for various types of fluids are available in the field. In most cases, solids are considered almost incompressible.

General Measurement Terms

Unless otherwise specified or unless the context otherwise clearly requires, any ratio or percentage means by volume.

Unless otherwise specified or unless the context otherwise clearly requires, the phrase "by weight of the water" means the weight of the water of an water phase of the fluid without the weight of any viscosity-increasing agent, dissolved salt, suspended particulate, or other materials or additives that may be present in the water.

If there is any difference between U.S. or Imperial units, U.S. units are intended. For example, "GPT" or "gal/Mgal" means U.S. gallons per thousand U.S. gallons and "ppt" means pounds per thousand U.S. gallons.

The barrel is the unit of measure used in the US oil industry, wherein one barrel equals 42 U.S. gallons. Standards bodies such as the American Petroleum Institute (API) have adopted the convention that if oil is measured in oil barrels, it will be at 14.696 psi and 60° F., whereas if it is measured in cubic meters, it will be at 101.325 kPa and 15° C. (or in some cases 20° C.). The pressures are the same but the temperatures are different—60° F. is 15.56° C., 15° C. is 59° F., and 20° C. is 68° F. However, if all that is needed is to convert a volume in barrels to a volume in cubic meters without compensating for temperature differences, then 1 bbl equals 0.159 $m^3$ or 42.0034 US gallons.

Unless otherwise specified, mesh sizes are in U.S. Standard Mesh.

Unless otherwise specified, percentage ranges such as "within about 30%" means within plus or minus the percentage of the base value.

Emulsions

An emulsion is a fluid including a dispersion of immiscible liquid particles in an external liquid phase. In addition, the proportion of the external and internal phases is above the solubility of either in the other. A chemical can be included to reduce the interfacial tension between the two immiscible liquids to help with stability against coalescing of the internal liquid phase, in which case the chemical may be referred to as a surfactant or more particularly as an emulsifier or emulsifying agent.

In the context of an emulsion, a "water phase" refers to a phase of water or an aqueous solution and an "oil phase" refers to a phase of any non-polar, organic liquid that is immiscible with water, usually an oil.

An emulsion can be an oil-in-water type or water-in-oil type. A water-in-oil emulsion is sometimes referred to as an invert emulsion.

It should be understood that multiple emulsions are possible. These are sometimes referred to as nested emulsions. Multiple emulsions are complex polydispersed systems where both oil-in-water and water-in-oil emulsions exist simultaneously in the fluid, wherein the oil-in-water emulsion is stabilized by a lipophilic surfactant and the water-in-oil emulsion is stabilized by a hydrophilic surfactant. These include water-in-oil-in-water and oil-in-water-in-oil type multiple emulsions. Even more complex polydispersed systems are possible. Multiple emulsions can be formed, for example, by dispersing a water-in-oil emulsion in water or an aqueous solution, or by dispersing an oil-in-water emulsion in oil.

A stable emulsion is an emulsion that will not cream, flocculate, or coalesce under certain conditions, including time and temperature. As used herein, the term "cream" means at least some of the droplets of a dispersed phase converge towards the surface or bottom of the emulsion (depending on the relative densities of the liquids making up the continuous and dispersed phases). The converged droplets maintain a discrete droplet form. As used herein, the term "flocculate" means at least some of the droplets of a dispersed phase combine to form small aggregates in the emulsion. As used herein, the term "coalesce" means at least some of the droplets of a dispersed phase combine to form larger drops in the emulsion.

Predicting Particulate Sag in Drilling Fluids

Predicting and controlling sag of weighting particulate in drilling fluids has been difficult, as the influence of fluid rheology on dynamic sag is not quantitatively established. A Dynamic High Angle Sag Tester ("DHAST") commercially available from FANN Instrument company, as generally disclosed in U.S. Pat. No. 6,584,833 to Jamison and Murphy, which is incorporated by reference herein, is an instrument that can measure the rate of particle settling to indicate the sag rate; however, this device has the disadvantage that it must be used in a laboratory setting and cannot be used in the field. Further, the DHAST equipment and method requires labor of about 2 man-hours per test and the test runs for a period of 15-18 hours.

Methods of predicting sag in the field have included variations of a viscometer sag test, in which drilling fluid is sheared inside a heat cup or well, and is subsequently analyzed for changes in density. In such tests, sag tendency is considered to be proportional to the change in density, but such tests do not provide a quantitative measure of the dynamic sag rate.

The present invention is a method to predict or control the sagged fluid composition and mud weight (also referred to as the sagged fluid density) as a particulate weighting agent such as barite accumulates in the wellbore column. In case of invert emulsion oil-based drilling fluids, the sagged fluid mud weight is expected to be strongly influenced by initial fluid mud weight, oil/water ratio, concentration of low gravity solids, as well as emulsion stability. The method is built and validated using the static aging tests on various oil-based muds where a bottom section of the static aged mud was analyzed using retort mud weight and titration tests.

The method predictions can provide unique information on the density difference that would be generated as the particulate weighting material settles in a fluid. This information can be used to understand and prevent well control issues such as stuck pipe, kick, or lost circulation that can occur due to sag of high-gravity solids. In addition, it can be correlated later to obtain the transient hydrostatic pressure profile along the wellbore column. The ability to predict sagged fluid mud weight would be crucial step in determining changes in torque or pump pressures when sag occurs.

Figure 2:
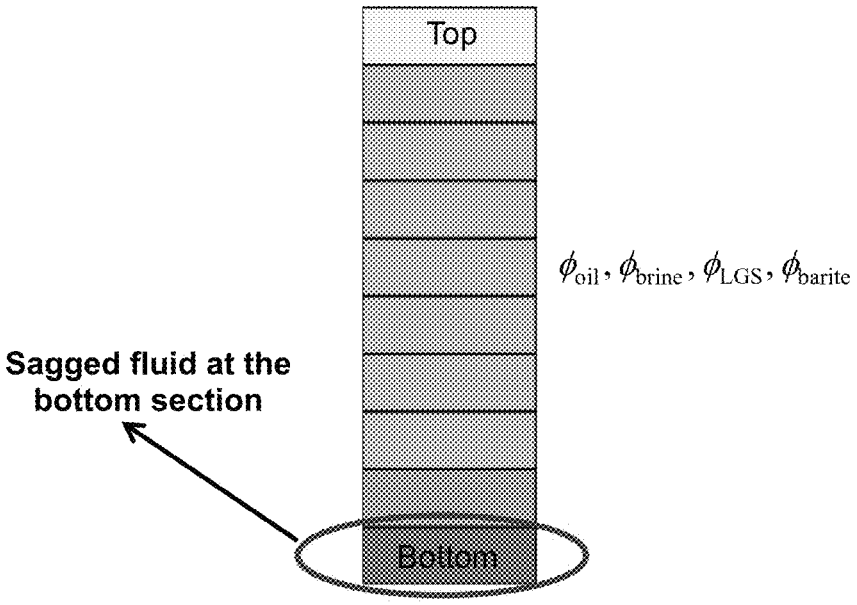
FIG. 2 is a schematic of barite settling in a static aging cell.

Here, using analysis of static aged mud, a method is derived to predict sagged fluid mud weight as the weighting material, e.g., barite, settles in the static cell or, similarly, in the wellbore. FIG. 2 is a schematic of barite settling in a static aging cell. The volume fractions of the mud components that include oil, brine, low gravity solids ("LGS"), and barite are denoted respectively as:

$$\phi_{oil}, \phi_{brine}, \phi_{LGS}, \phi_{barite}$$

For a given mud sample, these fractions were determined by performing component-wise mass balance on the data obtained from retort (oil/water ratio), mud weight (fluid density), and titration (salt concentration) tests. Once the fractions of the mud components are known, the mud weight of the sample may be determined as:

$$MW = \Sigma \rho_j * \phi_j$$

where MW is the fluid weight of a portion of the fluid;

where $\rho_j$ is the density of each of the components of the fluid; and where $\phi_j$ is the volume fraction of each of the components of the fluid.

For the initially uniform mud weight, the various fractions $\phi_j$ are more specifically denoted as:

$$\phi_{oil}^{i}, \phi_{brine}^{i}, \phi_{LGS}^{i}, \phi_{barite}^{i}$$

On the other hand, for the sagged fluid bottom section of the static aging cell after allowing settling of the particulate weighting material (see FIG. 2), the various fractions $\phi_j$ in the mud are more specifically denoted as:

$$\phi_{oil}^{s}, \phi_{brine}^{s}, \phi_{LGS}^{s}, \phi_{barite}^{s}$$

These fractions of mud components are estimated based on retort and mud weight tests.

Three postulates were considered to comprehend the process of settling of a weighting material (e.g., barite) as described below:

(I) The settling barite replaces oil only.

$$\phi_{brine}^{s} = \phi_{brine}^{i} \quad \text{(Eq. I)}$$

(II) The o/w ratio remains unchanged during barite settling.

$$\phi_{oil}^{s}/\phi_{brine}^{s} = \phi_{oil}^{i}/\phi_{brine}^{i} \quad \text{(Eq. II)}$$

(III) The barite settles along with brine, such that the barite/brine ratio remains unchanged as barite settles.

$$\phi_{barite}^{s}/\phi_{brine}^{s} = \phi_{barite}^{i}/\phi_{brine}^{i} \quad \text{(Eq. III)}$$

The retort mud weight and titration tests of the initially uniform mud as well as the sagged mud at the bottom of the static aging cell were performed for a range of oil-based muds. It was observed that the experimental data closely agrees to the postulate described by Eq. (III) above. In addition, it was observed that the total fraction of particulates and the water phase (including barite, LGS, as well as the water phase of brine) in the sagged mud is approximately in the range of about 0.6 to about 0.7. More particularly, the dispersed phase volume fraction in the sagged fluid section is approximately in the range of about 0.63 to about 0.68, that is:

$$\phi_{brine}^{s} + \phi_{LGS}^{s} + \phi_{barite}^{s} = \phi_{particulates+water\ phase}^{s} \approx 0.63\text{-}0.68 \quad \text{(Eq. IV)}$$

The above experimental study also showed that the fraction of LGS in the sagged mud at the bottom of the static aging cell remains almost same as that in the initial uniform mud, that is:

$$\phi_{LGS}^{s} \approx \phi_{LGS}^{i} \quad \text{(Eq. V)}$$

For low-density solids, it is believed that Eq. V would hold so long as the LGS volume fraction in the fluid is lower than about 10%.

Now, the above derived postulates of Eqs. III, IV, and V can be used to predict the sagged fluid composition and mud weight for a given mud having a known initially uniform composition. This method to determine composition (and correspondingly mud weight) of the sagged fluid bottom section was also validated for some unseen muds, that is, muds that were not used for deriving these postulates.

Materials and Methodology

The major components of an water-in-oil fluid (such as a drilling mud) are considered as oil, an water phase (such as water or brine), barite particulate, and one or more low gravity solids ("LGS") particulate. The fraction of a fluid component is the volume fraction of the mud component in the entire mud. For example:

$$\phi_{oil} = \frac{\text{volume of oil}}{\text{total volume of fluid}}$$

Several oil-based drilling fluids ("OBM") were formulated so as to have variations in the o/w ratio, initially uniform fluid mud weight, and initial low-gravity solids ("LGS") content.

After preparation, the drilling fluids were hot-rolled at 50 revolutions per minute in aging cells at 250° F. for 16 hours before performing the tests. Aging cells are used as the containers for the hot rolling. The fluid capacity of the aging cells is 500 ml, having a length of about 16 cm and an inner diameter of about 6.3 cm.

The standard 48-hour static aging test was performed on the selected OBMs for at 250° F. and under 100 psi pressure. A petri-dish container (capacity 25 ml) was placed at the bottom of the aging cell to collect the settled mud. This bottom portion of the settled mud in the petri-dish after aging represents the "sagged" ("s") bottom section of the static aged mud.

For each OBM, two standard retort tests were performed, first on the fresh initial ("i") mud after hot rolling with uniform composition and second on mud collected in the petri-dish at the bottom of static aging cell after aging, that is, "sagged" ("s") bottom section as shown in FIG. 2.

For each OBM, two standard mud weight tests were performed, first on the fresh initial ("i") mud after hot rolling with uniform composition and second on mud collected in the petri-dish at the bottom of static aging cell after aging, that is, "sagged" ("s") bottom section as shown in FIG. 2.

For each OBM, two standard titration (chemical analysis, API RECOMMENDED PRACTICE 13B-2 (section 9)) tests were performed, first on the fresh initial ("i") mud after hot rolling with uniform composition and second on mud collected in the petri-dish at the bottom of static aging cell after aging, that is, "sagged" ("s") bottom section as shown in FIG. 2.

Derivation of Postulates

As a basis for deriving the postulates, three invert emulsion fluids A, B, and C were formulated to have variations in initial fluid mud weight, o/w ratio, and amount of low gravity solids as shown in Table 1. These three fluids were designed so that the emulsion is stable, that is, the water phase does not separate from the oil phase.

TABLE 1

| | FLUID | | |
|---|---|---|---|
| | A | B | C |
| o/w (v/v) | 65/35 | 65/35 | 90/10 |
| Mud Weight, ppg | 12 | 14.5 | 12 |
| Base fluid I, bbl | As required | As required | None |
| Base fluid II, bbl | None | None | As required |
| Emulsifier (ppb) | 8 | 8 | 8 |
| Lime (ppb) | 1.5 | 1.5 | 1.5 |
| Filtration Control Agent (ppb) | 1.5 | 1.5 | 2.5 |
| $CaCl_2$ brine (200K) | As required | As required | As required |
| Low Gravity Solids I (ppb) | 5 | 5 | 5 |
| Low Gravity Solids II (ppb) | 5 | 5 | 20 |
| Low Gravity Solids III (ppb) | 20 | 10 | 20 |
| Total LGS (% by volume) | 3% | 2% | 5% |
| Barite Particulate (ppb) | As required | As required | As required |
| Viscosifier (ppb) | 3.5 | 3.5 | 3.5 |

After hot-rolling, the retort, mud weight and titration tests were conducted on the initially uniform ("i") drilling fluid. Afterwards, the uniform mud was kept for static aging of 48 hours at 250° F. A petri-dish container was placed at the bottom of the aging cell to collect the settled mud. Then, retort, mud weight and titration tests were also conducted on the sagged ("s") mud at bottom of the static aging cell. By performing component-wise mass balance on the retort, mud weight and titration data, the composition of components was obtained for the initially uniform as well as sagged bottom section; see Table 2. The volume fractions determined by the tests on the initially uniform ("i") as well as the sagged ("s") bottom section of fluids A, B, and C after static aging of 48 hours at 250° F. are shown in Table 2.

TABLE 2

| | $\phi_{brine}$ | | $\phi_{oil}$ | | $\phi_{barite}$ | | $\phi_{LGS}$ | |
|---|---|---|---|---|---|---|---|---|
| FLUID | (i) | (s) | (i) | (s) | (i) | (s) | (i) | (s) |
| A | 0.30 | 0.44 | 0.53 | 0.34 | 0.14 | 0.19 | 0.03 | 0.03 |
| B | 0.28 | 0.36 | 0.47 | 0.33 | 0.23 | 0.29 | 0.02 | 0.02 |
| C | 0.08 | 0.19 | 0.7 | 0.35 | 0.16 | 0.41 | 0.05 | 0.05 |

For each fluid test, the ratio of barite to brine was calculated from the data shown in Table 2. Table 3 shows a computational analysis of this above experimental data.

TABLE 3

| | $\phi_{barite}/\phi_{brine}$ | | Dispersed-phase volume fraction in | $\phi_{LGS}$ | |
|---|---|---|---|---|---|
| Fluid | (i) | (s) | sagged mud | (i) | (s) |
| A | 0.47 | 0.43 | 0.66 | 0.03 | 0.03 |
| B | 0.82 | 0.81 | 0.67 | 0.02 | 0.02 |
| C | 2 | 2.16 | 0.65 | 0.05 | 0.05 |

The analysis of the Table 3 data evidently shows that the barite settling process is not described by the postulates described by Eq. I or Eq. II.

As shown in Table 3, however, the ratio of barite to brine is essentially unchanged after aging; thus, the postulate described by Eq. III is supported by the experimental data. In addition, it was observed that the total fraction of the dispersed phase (including brine, barite, and LGS) in the sagged mud is about 0.63 to about 0.68; thus, the postulate described by Eq. IV is supported by the experimental data. Moreover, the fraction of LGS in the sagged mud at the bottom of the static aging cell remains about the same as that in the initial uniform mud, as described by the Eq. V.

Now, the above verified postulates Eqs. III, IV, and V can be used to predict the composition and accordingly mud weight of the sagged fluid section for a given mud with known initial composition. Table 4 shows comparison of predicted mud weight of the sagged fluid section to the experimental observed mud weight of the same section for the fluids A, B, C; it was found that the predictions closely agree with the experimental data (±0.5 ppg).

TABLE 4

| Fluid | Predicted mud weight of sagged fluid section (ppg) | Experimental mud weight of sagged fluid section (ppg) |
|---|---|---|
| A | 14.7 | 14.3 |
| B | 17.1 | 17.3 |
| C | 19.3 | 19.8 |

Validation of the Postulates

For "unseen" fluids (that is, fluids not used to develop the postulates) with given initial composition, the postulates described by Eqs. III, IV, and V were used to predict first the composition and then accordingly the mud weight of the sagged fluid section. The predicted mud weight was compared with experimentally obtained mud weight of the sagged bottom section (in the petri-dish container) of the static aging cell after aging of 48 hours at 250° F.

As a basis for further testing of the above postulates described by Eqs. III, IV, and V, two additional fluids were formulated that had variations in initially uniform mud weight, o/w ratio, amount of low gravity solids as shown in Table 5.

TABLE 5

| | FLUID | |
|---|---|---|
| | D | E |
| o/w (v/v) | 80/20 | 80/20 |
| Mud Weight, ppg | 12 | 14.5 |
| Base fluid II, bbl | As required | As required |
| Emulsifier (ppb) | 8 | 8 |
| Lime (ppb) | 1.5 | 1.5 |
| Filtration Control Agent (ppb) | 2.5 | 2.5 |
| $CaCl_2$ brine (200K) | As required | As required |
| Low Gravity Solids I (ppb) | 5 | 5 |
| Low Gravity Solids II (ppb) | 20 | 20 |
| Low Gravity Solids III (ppb) | 20 | 20 |
| Total LGS (% by volume) | 5% | 5% |
| Barite Particulate (ppb) | As required | As required |
| Viscosifier (ppb) | 3 | 3 |

Table 6 shows a comparison of predicted vs. experimental mud weight of the sagged fluid section at the bottom of the static aging cell in case of un-seen muds. As shown in Table 6, it was found that the predictions closely agree with the experimental data (±0.5 ppg). Thus, a method to determine composition and mud weight of the sagged fluid bottom section was developed and validated for oil-based drilling fluids.

TABLE 6

| Fluid | Predicted fluid weight of sagged fluid section (ppg) | Experimental fluid weight sagged fluid section (ppg) |
|---|---|---|
| D | 16.5 | 17 |
| E | 18.4 | 18 |

In the present invention, a method is developed to predict the sagged fluid composition and mud weight for an invert emulsion as the weighting agent (e.g., barite) accumulates in the wellbore column. The method predictions can provide unique information on the density differences that would be generated as the barite settles in a fluid. The accurate determination of the sagged fluid mud weight due to sag of the high-gravity solids is crucial as it could indicative to understand or avoid excessive drilling torque or pressure, kick, or lost circulation situation due to sag of the high-gravity solids in an invert fluid that is weighted with such solids.

The model and methods according to the invention will serve as a useful tool to the mud engineers to evaluate the sag behavior for a given fluid and to make speedy decisions at the rig site to optimize fluid formulations; this will consequently save the corresponding down-time and wellbore stability related issues.

Estimated Sag Rate

According to a further aspect, sag rate can also be estimated and employed with the determination of sagged fluid mud weight to help control a well. The sag rate information can obtained as described in co-pending U.S. patent application Ser. No. 13/492,885 entitled "Methods for Predicting Dynamic Sag Using Viscometer/Rheometer Data" filed on Jun. 10, 2012 and having for named inventors Sandeep Kulkarni, Sharath Savari, Kushabhau Teke, Dale Jamison, Robert Murphy, and Anita Gantepla, which is incorporated herein by reference in its entirety.

Preferably, a method to include predicting the sag rate for a particulate suspended in a fluid based on rheological properties of the fluid as described below.

The rheological data from a viscometer/rheometer can be obtained in terms of shear stress or viscosity at desired conditions of shear rate (γ), temperature (T) and pressure (P). Considering the shear-thinning characteristic of the drilling fluids, pseudoplastic models including power-law model, Eyring model, Cross model, Carrau model, Ellis model or the like may be applied to the Rheology data to extract the characteristic parameters. In addition, the rheology data may also be modeled considering the existence of yield stress (or apparent yield stress), i.e., using viscoplastic models. Different viscoplastic models may include Bingham-plastic model, Casson model, Herschel-Bulkley model or the like. The Rheological properties of the fluid that comprise of Rheological data or the characteristics parameters obtained by applying one or more of above pseudo-plastic/viscoplastic models are used in a equation to predict the sag rate behavior.

In one embodiment, the rheological properties include viscosity and viscoplastic characteristics from Herschel-Bulkley model in terms of yield stress, and shear thinning index. The viscosity, yield stress, and shear-thinning index can be obtained from a conventional (constant shear rate concentric cylinder viscometer/rheometer with an "API" geometry) viscometer/rheometer. In embodiments the conventional viscometer/rheometer can be a Fann®-35, Fann-50, Fann-75, or Fann-77 viscometer/Rheometer.

In an embodiment the sag rate invention illustrates that Gravitational Force=Viscous Drag+Viscoplastic Drag to describe settling behavior of the weighting material (e.g., barite) in drilling fluids. An example of this is shown in the equation that can be used with such rheological information is:

$$(4/3)*\pi*a_i^3*(\rho_s-\rho_f)*g=6*\pi*a_i*U_i*\mu+k*(\tau_0^{HB})^{1/n} \quad \text{Eq. VI}$$

where $a_i$ is the radius of the weighting material particle, $\rho_s$ is the density of the weighting material particle, $\rho_i$ is the density of the fluid surrounding the particle, g is the acceleration due to gravity, $U_i$ is the dynamic sag rate or vertical velocity of the sagging particle of size $a_i$, μ is the viscosity of the drilling fluid, k is an empirical constant that that can range from 0.01 to 10 when the terms in the equation are in SI units, $\Sigma_0^{HB}$ is the yield stress, and n is the shear thinning index. The rheological properties are obtained at desired conditions of shear rate (γ), temperature (T) and pressure (P).

In addition to shear stress or viscosity data from a viscometer/rheometer, the viscoelastic data may be obtained from a rheometer at desired conditions of temperature (T) and pressure (P). The viscoelastic data may be in terms of first Normal stress difference, second normal stress difference, primary normal stress coefficient, second normal stress coefficient, elongational viscosity, the dimensionless viscoelastic parameters including Maxwellian relaxation time, Deborah number, Weissenberg number, elasticity number and the like.

The rheological properties of the fluid that comprise of rheological data or the characteristics parameters obtained by applying one or more of above pseudoplastic/viscoplastic models or the above obtained viscoelastic properties are used in a equation to predict the sag rate behavior.

An embodiment includes a method of predicting the dynamic sag rate of a weighting material in a drilling fluid by obtaining rheological data from a rheological measuring device and introducing the rheological properties into an equation to determine the dynamic sag rate where the rheological properties comprises the viscosity of the fluid surrounding the weighting material and first Normal stress difference, optionally the rheometer is an Anton Paar rheometer.

In an embodiment, the rheological properties include the viscosity of the fluid surrounding the weighting material and viscoelastic properties that may comprise of first Normal stress difference that is defined as follows. For a viscoelastic fluid under flow, normal stresses in velocity and velocity gradient directions, $\tau_{xx}$ and $\tau_{yy}$, respectively, may become unequal and the difference ($\tau_{xx}-\tau_{yy}$) is defined first Normal stress difference $N_1$. The viscosity of the fluid surrounding the weighting material can be obtained using a conventional viscometer/rheometer, such as a Fann-35 viscometer/rheometer. The first Normal stress difference can be obtained using a rheometer, such as an Anton Paar rheometer. The settling behavior of barite in drilling fluids could be described as Gravitational Force=Viscous Drag+Viscoelastic Drag. An example of this is shown in the equation that can be used with such rheological properties is:

$$(4/3)*\pi*a^3*(\rho_s-\rho_f)*g=6*\pi*\eta*a*U+a*4*\pi*a^2*|N_1|^\beta \quad \text{Eq. VII}$$

where a is the average radius of the weighting material particle, $\rho_s$ is the density of the weighting material particle, $\rho_f$ is the density of the fluid surrounding the particle, $\eta$ is the viscosity of the fluid surrounding the weighting material, a is an empirical constant ranging from 0.0001 to 0.1, $|N_1|$ is the absolute value of the first Normal stress difference, and $\beta$ is an empirical constant ranging from 0.5 to 1.5. The rheological properties are obtained at a given condition of shear rate ($\gamma$), temperature (T) and pressure (P).

The information on $U_i$ i.e. the dynamic sag rate as described in Eq. VI and Eq. VII is obtained using a Dynamic High Angle Sag Tester ("DHAST") by FANN Instrument company, which is an instrument that can measure the rate of particle settling to indicate the sag rate; Thus, with the experimentally obtained Rheological and sag rate information, the empirical constants in Eq. VI and Eq. VII were determined and validated. With the derived empirical constants, Eq. VI and Eq. VII could successfully predict the sag rate for a particulate suspended in a fluid based on rheological properties of the fluid.

Methods Useful for Invert Emulsions Weighted with Barite

In general, the methods are useful with invert emulsions including at least: (a) an external oil phase; (b) an internal water phase adjacent the external phase; (c) an emulsifier; and (d) barite.

Preferably, the ratio of oil phase to water phase of the water-in-oil (invert) emulsion is in the range of about o/w=50:50 v/v to about o/w=95:5 v/v. For example, in an embodiment, the emulsion can include about 70% by volume of an oil phase and about 30% by volume of a dispersed water phase.

External Oil Phase

In an embodiment, the oil phase includes an a natural or synthetic source of an oil. Examples of oils from natural sources include, without limitation, kerosene, diesel oils, crude oils, gas oils, fuel oils, paraffin oils, mineral oils, low toxicity mineral oils, other petroleum distillates, and combinations thereof. Examples of synthetic oils include, without limitation, polyolefins, polydiorganosiloxanes, siloxanes, and organosiloxanes.

Internal Water Phase

Preferably, the water phase includes at least 50% by weight water, excluding the weight of any dissolved salts or other dissolved solids.

The water phase can include other water-soluble or water-miscible liquids such as glycerol.

In an embodiment, the water phase comprises a dissolved salt. Preferably, the water-soluble salt is selected from the group consisting of: an alkali metal halide, alkaline earth halide, alkali metal formate, and any combination thereof. For example, the dissolved salt can be selected from the group consisting of: sodium chloride, calcium chloride, calcium bromide, zinc bromide, sodium formate, potassium formate, sodium acetate, potassium acetate, calcium acetate, ammonium acetate, ammonium chloride, ammonium bromide, zinc bromide, sodium nitrate, potassium nitrate, ammonium nitrate, calcium nitrate, and any combination thereof. In an embodiment, the water phase can comprise a salt substitute, for example, trimethyl ammonium chloride. A purpose of a dissolved salt can be, among other things, to add to the weight (i.e., the density) of the water phase of the emulsion.

For example, a suitable water phase can include, without limitation, fresh water, seawater, salt water (e.g., saturated or unsaturated), and brine (e.g., saturated salt water). Suitable brines can include heavy brines.

In an embodiment, the water phase has a pH in the range of 5 to 9. More preferably, the water phase has a pH in the range of 5 to 8.

In certain embodiments, the water phase can include a pH-adjuster. Preferably, the pH adjuster does not have undesirable properties for the fluid. A pH-adjuster can be present in the water phase in an amount sufficient to adjust the pH of the fluid to within the desired range.

In general, a pH-adjuster may function, inter alia, to affect the hydrolysis rate of the viscosity-increasing agent. In some embodiments, a pH-adjuster may be included in the fluid, inter alia, to adjust the pH of the fluid to, or maintain the pH of the fluid near, a pH that balances the duration of certain properties of the fluid (e.g. the ability to suspend particulate) with the ability of the breaker to reduce the viscosity of the fluid or a pH that will result in a decrease in the viscosity of the fluid such that it does not hinder production of hydrocarbons from the formation.

One of ordinary skill in the art, with the benefit of this disclosure, will recognize the appropriate pH-adjuster, if any, and amount thereof to use for a chosen application according to this disclosure.

Emulsifier

Surfactants are compounds that lower the surface tension of a liquid, the interfacial tension between two liquids, or that between a liquid and a solid. Surfactants may act as detergents, wetting agents, emulsifiers, foaming agents, and dispersants.

Surfactants are usually organic compounds that are amphiphilic, meaning they contain both hydrophobic groups ("tails") and hydrophilic groups ("heads"). Therefore, a surfactant contains both a water-insoluble portion (or oil soluble) and a water-soluble portion.

In a water phase, surfactants form aggregates, such as micelles, where the hydrophobic tails form the core of the aggregate and the hydrophilic heads are in contact with the surrounding liquid. Other types of aggregates such as spherical or cylindrical micelles or bilayers can be formed. The shape of the aggregates depends on the chemical structure of the surfactants, depending on the balance of the sizes of the hydrophobic tail and hydrophilic head.

As used herein, the term micelle includes any structure that minimizes the contact between the lyophobic ("solvent-repelling") portion of a surfactant molecule and the solvent, for example, by aggregating the surfactant molecules into structures such as spheres, cylinders, or sheets, wherein the lyophobic portions are on the interior of the aggregate structure and the lyophilic ("solvent-attracting") portions are on the exterior of the structure. Micelles can function, among other purposes, to stabilize emulsions, break emulsions, stabilize a foam, change the wettability of a surface, solubilize certain materials, or reduce surface tension.

As used herein, an emulsifier refers to a type of surfactant that helps prevent the droplets of the dispersed phase of an emulsion from flocculating or coalescing in the emulsion.

An emulsifier can be or include a cationic, a zwitterionic, or a nonionic emulsifier. A surfactant package can include one or more different chemical surfactants.

The hydrophilic-lipophilic balance ("HLB") of a surfactant is a measure of the degree to which it is hydrophilic or lipophilic, determined by calculating values for the different regions of the molecule, as described by Griffin in 1949 and 1954. Other methods have been suggested, notably in 1957 by Davies.)

In general, Griffin's method for non-ionic surfactants as described in 1954 works as follows:

$$HLB=20*Mh/M$$

where Mh is the molecular mass of the hydrophilic portion of the molecule, and M is the molecular mass of the whole molecule, giving a result on a scale of 0 to 20. An HLB value of 0 corresponds to a completely lipidphilic/hydrophobic molecule, and a value of 20 corresponds to a completely hydrophilic/lypidphobic molecule. Griffin W C: "Classification of Surface-Active Agents by 'HLB,'" Journal of the Society of Cosmetic Chemists 1 (1949): 311. Griffin W C: "Calculation of HLB Values of Non-Ionic Surfactants," Journal of the Society of Cosmetic Chemists 5 (1954): 249.

The HLB (Griffin) value can be used to predict the surfactant properties of a molecule, where a value less than 10 indicates that the surfactant molecule is lipid soluble (and water insoluble), whereas a value greater than 10 indicates that the surfactant molecule is water soluble (and lipid insoluble).

In addition, the HLB (Griffin) value can be used to predict the uses of the molecule, where: a value from 4 to 8 indicates an anti-foaming agent, a value from 7 to 11 indicates a water-in-oil emulsifier, a value from 12 to 16 indicates oil-in-water emulsifier, a value from 11 to 14 indicates a wetting agent, a value from 12 to 15 indicates a detergent, and a value of 16 to 20 indicates a solubilizer or hydrotrope.

In 1957, Davies suggested an extended HLB method based on calculating a value based on the chemical groups of the molecule. The advantage of this method is that it takes into account the effect of stronger and weaker hydrophilic groups. The method works as follows:

$$HLB=7+m*Hh-n*Hl$$

where m is the number of hydrophilic groups in the molecule, Hh is the value of the hydrophilic groups, n is the number of lipophilic groups in the molecule, and Hl is the value of the lipophilic groups. The specific values for the hydrophilic and hydrophobic groups are published. See, e.g., Davies J T: "A quantitative kinetic theory of emulsion type, I. Physical chemistry of the emulsifying agent," Gas/Liquid and Liquid/Liquid Interface. Proceedings of the International Congress of Surface Activity (1957): 426-438.

The HLB (Davies) model can be used for applications including emulsification, detergency, solubilization, and other applications. Typically a HLB (Davies) value will indicate the surfactant properties, where a value of 1 to 3 indicates anti-foaming of aqueous systems, a value of 3 to 7 indicates W/O emulsification, a value of 7 to 9 indicates wetting, a value of 8 to 28 indicates oil-in-water emulsification, a value of 11 to 18 indicates solubilization, and a value of 12 to 15 indicates detergency and cleaning.

In an embodiment, the emulsifier is selected from the group consisting of: polyaminated fatty acids and their salts, quaternary ammonium compounds, and tallow based compounds.

In an embodiment, the emulsifier is a non-ionic emulsifier.

In an embodiment, the emulsion includes an emulsifier having a HLB (Davies scale) in the range of 3 to 7.

The emulsifier is preferably in a concentration of at least 0.1% by weight of the water of the emulsion. More preferably, the emulsifier is in a concentration in the range of 1% to 10% by weight of the water phase.

Particulate Weighting Agents ("High-Gravity Solids")

Weighting agents are commonly used in fluids. As used herein a weighting agent has an intrinsic density or specific gravity greater than 2.7. Preferably, the weighting agent has a specific gravity in the range of 2.7 to 8.0. Weighting agents are sometimes referred to herein as "high-gravity solids" or "HGS".

Various types of "high gravity solids" along with their respective densities could be found in Table 7. Thus, barite would be an example.

TABLE 6

| HGS material | Density (Specific Gravity) |
|---|---|
| ground hematite | 5.1-5.3 |
| iron oxide | 5.1-5.8 |
| Ground manganese Tetroxide | 4.7-4.9 |
| Galena | 7.2-7.6 |
| Magnetite | 5.1-5.2 |
| Ilmenite | 4.7-4.8 |
| Barite | 4.0-4.5 |
| Siderite | 3.9-4.0 |
| Celesite | 3.9-4.0 |
| Dolomite | 2.8-2.9 |

Any suitable particulate weighting agent can be employed according to the invention. For example, barite is a mineral consisting essentially of barium sulfate ($BaSO_4$). Barite is insoluble in water or oil and has a true density in the range of about 4.0 to 4.5 g/cm. It can be formed into a particulate useful as a weighting agent in drilling fluids or other fluids. Other examples of weighting agents include, for example, particulate weighting material such as barite, hematite, iron oxide, manganese tetroxide, galena, magnetite, lilmenite, siderite, celesite, or any combination thereof.

Preferably, the HGS particulate has a particle size distribution anywhere in the range of 0.1 to 500 micrometers.

Optional Low-Density Particulate ("Low-Gravity Solids")

In addition to one or more weighting agents, low-gravity solids (that is, solids in particulate form having a true density less than the density of barite) can be included in the fluid.

As used herein, "low gravity solids" or "LGS" are particulates in the density range of the density of the oil phase up to 2.7 Specific Gravity. Examples include calcium carbonate, marble, or any combination thereof.

If included, the LGS particulate preferably has a particle size distribution anywhere in the range of 0.1 to 500 micrometers.

Optional Fluid-Loss Control Agent (Aka Filtration Agent)

Fluids used in drilling, completion, or servicing of a wellbore can be lost to the subterranean formation while circulating the fluids in the wellbore. In particular, the fluids may enter the subterranean formation via depleted zones, zones of relatively low pressure, lost circulation zones having naturally occurring fractures, weak zones having fracture gradients exceeded by the hydrostatic pressure of the drilling fluid, and so forth. The extent of fluid losses to the formation may range from minor (for example less than 10 bbl/hr) referred to as seepage loss to severe (for example, greater than 500 bbl/hr) referred to as complete loss. As a result, the service provided by such fluid is more difficult to achieve. For example, a drilling fluid may be lost to the formation, resulting in the circulation of the fluid in the wellbore being too low to allow for further drilling of the wellbore.

Fluid loss refers to the undesirable leakage of a fluid phase of any type of fluid into the permeable matrix of a zone, which zone may or may not be a treatment zone. Fluid-loss control refers to treatments designed to reduce such undesirable leakage. Providing effective fluid-loss control for fluids during certain stages of well operations is usually highly desirable.

The usual approach to fluid-loss control is to substantially reduce the permeability of the matrix of the zone with a fluid-loss control material that blocks the permeability at or near the face of the rock matrix of the zone. For example, the fluid-loss control material may be a particulate that has a size selected to bridge and plug the pore throats of the matrix. All else being equal, the higher the concentration of the appropriately sized particulate, the faster bridging will occur. As the fluid phase carrying the fluid-loss control material leaks into the formation, the fluid-loss control material bridges the pore throats of the matrix of the formation and builds up on the surface of the borehole or fracture face or penetrates only a little into the matrix. The buildup of solid particulate or other fluid-loss control material on the walls of a wellbore or a fracture is referred to as a filter cake. Depending on the nature of a fluid phase and the filter cake, such a filter cake may help block the further loss of a fluid phase (referred to as a filtrate) into the subterranean formation. A fluid-loss control material is specifically designed to lower the volume of a filtrate that passes through a filter medium. Accordingly, a fluid-loss control material is sometimes referred to as a filtration control agent.

Fluid-loss control materials are sometimes used in drilling fluids or in treatments that have been developed to control fluid loss. A fluid-loss control pill is a fluid that is designed or used to provide some degree of fluid-loss control. Through a combination of viscosity, solids bridging, and cake buildup on the porous rock, these pills oftentimes are able to substantially reduce the permeability of a zone of the subterranean formation to fluid loss. They also generally enhance filter-cake buildup on the face of the formation to inhibit fluid flow into the formation from the wellbore.

Fluid-loss control agents can include a polymeric viscosifying agent (usually crosslinked) or bridging particles, such as sand, calcium carbonate particulate, or degradable particulate. To crosslink the viscosifying polymers, a suitable crosslinking agent that includes polyvalent metal ions is used. Boron, aluminum, titanium, and zirconium are common examples. Viscoelastic surfactants can also be used.

If included, a fluid-loss additive may be added to a fluid in an amount necessary to give the desired fluid-loss control. In some embodiments, a fluid-loss additive may be included in an amount of about 5 to about 200 lbs/Mgal of the fluid. In some embodiments, the fluid-loss additive may be included in an amount from about 10 to about 50 lbs/Mgal of the fluid.

Optional Viscosity-Increasing Agent (Aka Viscosifier)

A fluid can be adapted to be a carrier fluid for particulates.

For example, during drilling, rock cuttings should be carried uphole by the drilling fluid and flowed out of the wellbore. The rock cuttings typically have specific gravity greater than 2, which is much higher than that of many drilling fluids. These high-density cuttings have a tendency to separate from water or oil very rapidly.

Increasing the viscosity of a fluid can help prevent a particulate having a different specific gravity than a surrounding phase of the fluid from quickly separating out of the fluid.

A viscosity-increasing agent can be used to increase the ability of a fluid to suspend and carry a particulate material in a fluid.

A viscosity-increasing agent is sometimes referred to in the art as a viscosifying agent, viscosifier, thickener, gelling agent, or suspending agent. In general, any of these refers to an agent that includes at least the characteristic of increasing the viscosity of a fluid in which it is dispersed or dissolved. As known to persons of skill in the art, there are several kinds of viscosity-increasing agents or techniques for increasing the viscosity of a fluid.

If used, a viscosity-increasing agent should be present in a fluid in a form and in an amount at least sufficient to impart the desired viscosity to a fluid. For example, a viscosity-increasing agent can be present in the fluids in a concentration in the range of from about 0.01% to about 5% by weight of the continuous phase therein.

Other Fluid Additives

A fluid can optionally contain other additives that are commonly used in oil field applications, as known to those skilled in the art.

Methods of Drilling or Treating a Well

The calculations and methods for determining sagged fluid composition and mud weight can be used, for example, to help control the drilling or treatment in a well. For example, according to an embodiment of the invention, a method of drilling a well is provided, the method including the steps of: designing a fluid as an invert emulsion with barite according to the invention; calculating the sagged fluid weight of the fluid according to the formulas as described above, forming a fluid according to the calculations of the sagged fluid mud weight, and introducing the fluid into the well.

In an embodiment according to the invention, a method of managing or controlling a drilling operation in a well is provided, the method comprising the steps of:

(A) obtaining composition and initially uniform mud weight of a drilling fluid;

(B) obtaining wellbore flow conditions in the well operation, including trip-in and trip-out timings, rate of drill pipe rotation, and drilling fluid circulation rate;

(C) estimating an initial equivalent circulation density for the drilling fluid based on the initial uniform mud weight of the drilling fluid;

(D) estimating or experimentally determining a sagged fluid mud weight ($MW^s$) for the drilling fluid;

(E) re-evaluating a later equivalent circulation density based on the estimated $MW^s$; and (F) modifying the drilling fluid or the wellbore flow conditions to manage or control the well or avoid an equivalent circulation density difference greater than 0.05 ppg in the well.

In another embodiment according to the invention, a method of drilling or treating a portion of a well is provided, the method comprising the steps of:

(A) designing or obtaining a fluid comprising the following components:

(i) a continuous oil phase;

(ii) an internal water phase;

(iii) one or more high-gravity solids in particulate form, wherein the high-gravity solids are insoluble in both the oil phase and the water phase; and optionally (iv) one or more low-gravity solids in particulate form, wherein the low-gravity solids are insoluble in both the oil phase and the water phase;

(B) determining:

$$MW^i = \Sigma \rho_j^i * \phi_j^i$$

where $MW^i$ is the mud weight of the fluid when it is initially uniform;

where $\rho_j^i$ is the density of each of the components of the fluid when it is initially uniform; and where $\phi_j^i$ is the volume fraction of each of the components of the fluid when it is initially uniform;

(C) predicting a sagged fluid mud weight of a sagged portion of the fluid as:

$$MW^s = \Sigma \rho_j^s * \phi_j^s$$

where $MW^s$ is the sagged fluid mud weight of a sagged portion of the fluid after allowing time for sag in the fluid of the high-gravity solids when the fluid is under conditions of low shear or no shear;

where $\rho_j^s$ for each of the components of the sagged portion is selected to be adjusted for a design temperature and pressure in the portion of the well, or where $\rho_j^s$ for each of the components of the sagged portion selected to be within about 30% of the $\rho_j^i$ of each of the components of the fluid, respectively, or preferably wherein where $\rho_j^s$ for each of the components of the sagged portion is selected to be anywhere within about 20% of the $\rho_j^i$ of each of the component of the fluid, respectively, or still more preferably wherein where $\rho_j^s$ for each of the components of the sagged portion is selected to be about equal to the $\rho_j^i$ of each of the component of the fluid (in which case, the density of the individual components is selected as not changing);

where $\phi_j^s$ is the volume fraction of each of the components of the sagged portion, wherein:

the ratio of $\phi_j^s$ for each of the high-gravity solids to $\phi_j^s$ for the water phase is selected to be within 20% of the ratio of $\phi_j^i$ for each of the high-gravity solids to $\phi_j^i$ for the water phase, respectively, or preferably the ratio of $\phi_j^s$ for each of the high-gravity solids to $\phi_j^s$ for the water phase is selected to be about equal to the ratio of $\phi_j^i$ for each of the high-gravity solids to $\phi_j^i$ for the water phase, respectively;

$\phi_j^s$ for each of the low-gravity solids is selected to be anywhere in the range of zero to 2 times $\phi_j^i$ for each of the low-gravity solids, respectively, or preferably $\phi_j^s$ for each of the low-gravity solids is selected to be anywhere in the range of 0.8 to 1.2 times of $\phi_j^i$ each of the low-gravity solids, or more preferably $\phi_j^s$ for each of the low-gravity solids is selected to be about equal to $\phi_j^i$ for each of the low-gravity solids;

the sum of $\phi_j^s$ for the water phase, $\phi_j^s$ for each of the high-gravity solids, and $\phi_j^s$ for each of the low-gravity solids is selected to be anywhere in the range of 0.5 to 0.75, or preferably the sum is selected to be anywhere in the range of 0.60 to 0.70, or more preferably the sum is selected to be anywhere in the range of 0.63 to 0.68; and the $\phi_j^s$ for the oil phase is selected to be the balance of the volume fraction of the sagged portion;

(D) designing or obtaining wellbore flow conditions in the well;

(E) determining whether the $MW^s$ is sufficient for control of the well or sufficient for avoiding an equivalent circulation density difference greater than 0.1 ppg in the well;

(F) modifying the fluid or flow conditions to control the well or avoid the equivalent circulation density difference greater than 0.1 ppg in the well; and (G) flowing the fluid in the well.

It should be understood, of course, that $\rho_j^i$ for the density of each of the components of the fluid; and $\phi_j^i$ the volume fraction of each of the components of the fluid would be easily known or determined at the time of designing or forming the fluid.

It should be understood that the step of calculating can be performed with the aid of a computer device, such as a calculator or computer.

Figure 3:
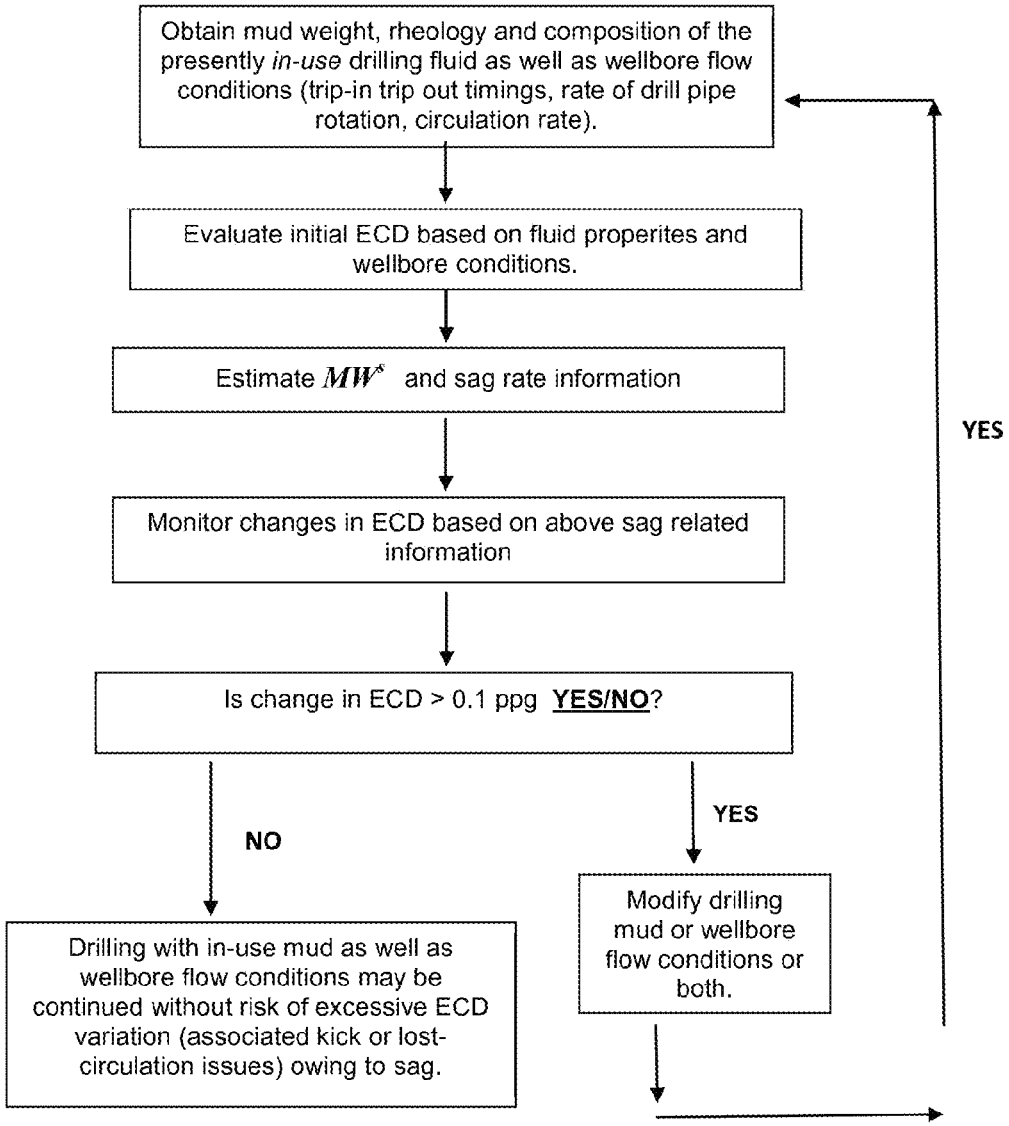
FIG. 3 is a flow chart illustrating a method of controlling a well including with the benefit of the present invention.

The $MW^s$ (as in the above methods) can be used, for example, to help manage or control a well during a well servicing operation. According to another embodiment illustrated in FIG. 3, for example, a method of managing or controlling a well operation can include the steps of:

(A) obtaining a mud weight, rheology, and composition of an in-use drilling fluid and wellbore flow conditions including trip-in and trip-out timings, rate of drill pipe rotation, and drilling fluid circulation rate;

(B) estimating an initial ECD for the in-use drilling fluid in the well;

(C) estimating the $MW^s$ (as in the above method), possible location of $MW^s$ in the wellbore and sag rate information, wherein the sag rate information can obtained as described in co-pending U.S. patent application Ser. No. 13/492,885 entitled "Methods for Predicting Dynamic Sag Using Viscometer/Rheometer Data" filed on Jun. 10, 2012 and having for named inventors Sandeep Kulkarni, Sharath Savari, Kushabhau Teke, Dale Jamison, Robert Murphy, and Anita Gantepla, which is incorporated herein by reference in its entirety;

(D) re-evaluating the ECD based on the $MW^s$ and sag rate information; and (E) if the re-evaluated ECD less the initial ECD is greater than 0.05 ppg, modifying the drilling fluid or wellbore flow conditions or both to manage or control the well during the well servicing operation.

Figure 1B:
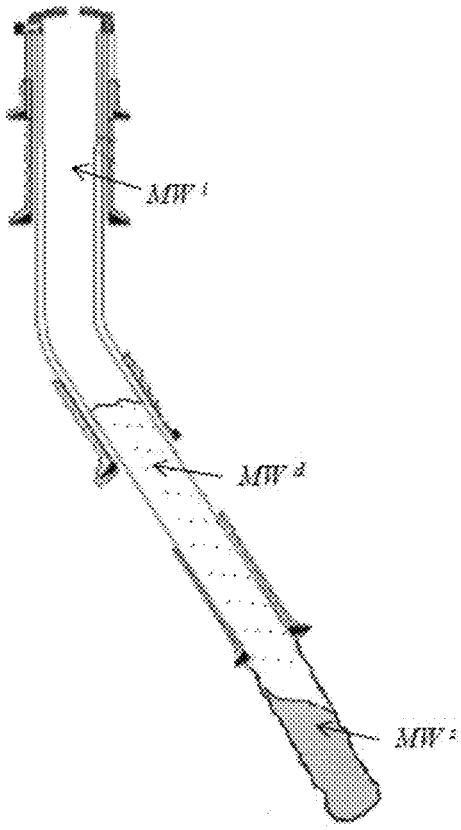

A simplistic example of ECD determination at a wellbore bottom as shown in FIG. 1(*a*) is:

$$ECD = (\mathrm{MW})^i + \frac{\Delta P}{0.052 \times TVD}$$

where $(MW)^i$ is corrected for effect of wellbore temperature, pressure, and fluid compressibility.

where $\Delta P$ is the total pressure drop in annulus and TVD is the vertical depth of the wellbore. The $\Delta P$ is evaluated using standard drilling fluids practices (API RP 13D, Rheology and hydraulics of oil-well drilling fluids) or software.

A simplistic example of ECD determination in case of sagged mud for a representative wellbore shown in FIG. 1(*b*) is:

$$ECD = (MW)^e + \left[\frac{\Delta P^i}{0.052 \times TVD^i} + + \frac{\Delta P^d}{0.052 \times TVD^d} + \frac{\Delta P^s}{0.052 \times TVD^s}\right]$$

where $(MW)^e$ is the average fluid mud weight in the annulus resulting from a simple mass balance using $(MW)^i$, $(MW)^d$ and $(MW)^s$ (corrected for effect of wellbore temperature, pressure and fluid compressibility);

where $\Delta P^i$ is the pressure drop in the section of annulus with mud density $MW^i$ and $TVD^i$ is the vertical depth of corresponding section;

where $\Delta P^d$ is the pressure drop in the section of annulus with depleted mud density $MW^d$ and $TVD^d$ is the vertical depth of corresponding section;

where $\Delta P^s$ is the pressure drop in the section of annulus with sagged mud density $MW^s$ and $TVD^s$ is the vertical depth of corresponding section; and where the $\Delta P$ for each of the above sections is estimated using standard drilling fluids practices (API RP 13D, Rheology and hydraulics of oil-well drilling fluids) or software along with additional viscosity information of fluids in the sagged and depleted section. The viscosity information of fluids in the sagged and depleted portions can be determined experimentally or using empirical methods e.g. as described in the published article "*Hindrance Effect on Barite Sag in Non-Aqueous Drilling Fluids* (AADE-12-FTCE-23)".

A fluid can be prepared at the job site, prepared at a plant or facility prior to use, or certain components of the fluid can be pre-mixed prior to use and then transported to the job site. Certain components of the fluid may be provided as a "dry mix" to be combined with fluid or other components prior to or during introducing the fluid into the well.

In certain embodiments, the preparation of a fluid can be done at the job site in a method characterized as being performed "on the fly." The term "on-the-fly" is used herein to include methods of combining two or more components wherein a flowing stream of one element is continuously introduced into flowing stream of another component so that the streams are combined and mixed while continuing to flow as a single stream as part of the on-going treatment. Such mixing can also be described as "real-time" mixing.

Often the step of delivering a fluid into a well is within a relatively short period after forming the fluid, e.g., less within 30 minutes to one hour. More preferably, the step of delivering the fluid is immediately after the step of forming the fluid, which is "on the fly."

It should be understood that the step of delivering a fluid into a well can advantageously include the use of one or more fluid pumps.

In an embodiment, the step of introducing is at a rate and pressure below the fracture pressure of the treatment zone.

In an embodiment, the step of introducing includes circulating the fluid in the well while drilling.

In an embodiment, the step of circulating the fluid downhole in the well is under conditions of a circulation rate of less than 100 ft/min or drill pipe rotation speed less than 100 RPM anywhere in the wellbore for at least about 1 hour.

Preferably, after any such drilling or well treatment with a fluid according to the invention, a step of producing hydrocarbon from the subterranean formation is the desirable objective.

Conclusion

Therefore, the present invention is well adapted to attain the ends and advantages mentioned as well as those that are inherent therein.

The exemplary fluids disclosed herein may directly or indirectly affect one or more components or pieces of equipment associated with the preparation, delivery, recapture, recycling, reuse, or disposal of the disclosed fluids. For example, the disclosed fluids may directly or indirectly affect one or more mixers, related mixing equipment, mud pits, storage facilities or units, fluid separators, heat exchangers, sensors, gauges, pumps, compressors, and the like used generate, store, monitor, regulate, or recondition the exemplary fluids. The disclosed fluids may also directly or indirectly affect any transport or delivery equipment used to convey the fluids to a well site or downhole such as, for example, any transport vessels, conduits, pipelines, trucks, tubulars, or pipes used to fluidically move the fluids from one location to another, any pumps, compressors, or motors (e.g., topside or downhole) used to drive the fluids into motion, any valves or related joints used to regulate the pressure or flow rate of the fluids, and any sensors (i.e., pressure and temperature), gauges, or combinations thereof, and the like. The disclosed fluids may also directly or indirectly affect the various downhole equipment and tools that may come into contact with the chemicals/fluids such as, but not limited to, drill string, coiled tubing, drill pipe, drill collars, mud motors, downhole motors or pumps, floats, MWD/LWD tools and related telemetry equipment, drill bits (including roller cone, PDC, natural diamond, hole openers, reamers, and coring bits), sensors or distributed sensors, downhole heat exchangers, valves and corresponding actuation devices, tool seals, packers and other wellbore isolation devices or components, and the like.

The particular embodiments disclosed above are illustrative only, as the present invention may be modified and practiced in different but equivalent manners apparent to those skilled in the art having the benefit of the teachings herein. It is, therefore, evident that the particular illustrative embodiments disclosed above may be altered or modified and all such variations are considered within the scope and spirit of the present invention.

The various elements or steps according to the disclosed elements or steps can be combined advantageously or practiced together in various combinations or sub-combinations of elements or sequences of steps to increase the efficiency and benefits that can be obtained from the invention.

The invention illustratively disclosed herein suitably may be practiced in the absence of any element or step that is not specifically disclosed or claimed.

Furthermore, no limitations are intended to the details of construction, composition, design, or steps herein shown, other than as described in the claims.

What is claimed is:

1. A method of drilling or treating a portion of a well, the method comprising the steps of:

(A) designing or obtaining a fluid comprising the following components:

(i) a continuous oil phase;

(ii) an internal water phase;

(iii) one or more high-gravity solids in particulate form, wherein the high-gravity solids have a specific gravity in the range of 2.7 to 8.0 and are insoluble in both the oil phase and the water phase; and optionally (iv) one or more low-gravity solids in particulate form, wherein the low-gravity solids are insoluble in both the oil phase and the water phase;

(B) determining:

$$MW^i = \Sigma \rho_j^{\,i} * \phi_j^{\,i}$$

where $MW^i$ is the mud weight of the fluid when the fluid is a uniformly dispersed fluid;

where $\rho_j^i$ is the density of each of the components of the fluid when the fluid is a uniformly dispersed fluid; and where $\phi_j^i$ is the volume fraction of each of the components of the fluid when the fluid is a uniformly dispersed fluid;

(C) predicting a sagged fluid mud weight ($MW^s$) of a portion of the fluid as:

$$MW^s=\Sigma\rho_j^{s*}\phi_j^s$$

where the portion of the fluid has a higher density than when the fluid is a uniformly dispersed fluid due to settling of the high-gravity solids;

where $MW^s$ is the sagged fluid mud weight of the portion of the fluid after allowing time for sag in the fluid of the high-gravity solids when the fluid is under conditions of low shear or no shear;

where $\rho_j^s$ for each of the components of the portion is selected to be adjusted for a design temperature and pressure in the portion of the well or where $\rho_j^s$ for each of the components of the portion selected to be within 30% of the $\rho_j^i$ of each of the components of the fluid, respectively;

where $\phi_j^s$ is the volume fraction of each of the components of the portion, wherein:

the ratio of $\phi_j^s$ for each of the high-gravity solids to $\phi_j^s$ for the water phase is selected to be within 20% of the ratio of $\phi_j^i$ for each of the high-gravity solids to $\phi_j^i$ for the water phase, respectively;

$\phi_j^s$ for each of the low-gravity solids is selected to be anywhere in the range of zero to 2 times $\phi_j^i$ for each of the low-gravity solids, respectively;

the sum of $\phi_j^s$ for the water phase, $\phi_j^s$ for each of the high-gravity solids, and $\phi_j^s$ for each of the low-gravity solids is selected to be anywhere in the range of 0.5 to 0.75; and the $\phi_j^s$ for the oil phase is selected to be the balance of the volume fraction of the portion;

(D) designing or obtaining wellbore flow conditions in the well;

(E) determining whether the $MW^s$ is sufficient for control of the well or avoiding an equivalent circulation density difference greater than 0.05 ppg in the well;

(F) modifying the fluid or the flow conditions to control the well or avoid the equivalent circulation density difference greater than 0.1 ppg in the well; and (G) flowing the fluid in the well.

2. The method according to claim 1, wherein the portion of the fluid is a bottom portion of the fluid under a laboratory static aging test of 48 hours at the design temperature of the portion of the well.

3. The method according to claim 1, wherein $\rho_j^s$ for each of the components of the portion is selected to be anywhere within 10% of the $\rho_j^i$ of each of the component of the fluid.

4. The method according to claim 1, wherein $\rho_j^s$ for each of the components of the portion is selected to be about equal to the $\rho_j^i$ of each of the component of the fluid.

5. The method according to claim 1, wherein the ratio of $\phi_j^s$ for each of the high-gravity solids to $\phi_j^s$ for the water phase is selected to be about equal to the ratio of $\phi_j^i$ for each of the high-gravity solids to $\phi_j^i$ for the water phase, respectively.

6. The method according to claim 1, wherein $\phi_j^s$ for each of the low-gravity solids is selected to be anywhere in the range of 0.8 to 1.2 times of $\phi_j^i$ each of the low-gravity solids.

7. The method according to claim 1, wherein $\phi_j^s$ for each of the low-gravity solids is selected to be about equal to $\phi_j^i$ for each of the low-gravity solids.

8. The method according to claim 1, wherein the sum of $\phi_j^s$ for the water phase, $\phi_j^s$ for each of the high-gravity solids, and $\phi_j^s$ for each of the low-gravity solids is selected to be anywhere in the range of 0.60 to 0.70.

9. The method according to claim 1, wherein the sum of $\phi_j^s$ for the water phase, $\phi_j^s$ for each of the high-gravity solids, and $\phi_j^s$ for each of the low-gravity solids is selected to be anywhere in the range of 0.63 to 0.68.

10. The method according to claim 1, wherein the oil phase comprises crude oil, petroleum distillates, diesel, kerosene, diesel oils, crude oils, gas oils, fuel oils, paraffin oils, mineral oils, low toxicity mineral oils, other petroleum distillates, polyolefins, polydiorganosiloxanes, siloxanes, organosiloxanes, and any combination thereof.

11. The method according to claim 1, wherein the water phase comprises a water-soluble salt or soluble liquid.

12. The method according to claim 11, wherein the water-soluble salt is selected from the group consisting of: an alkali metal halide, alkaline earth halide, alkali metal formate, and any combination thereof.

13. The method according to claim 1, wherein the one or more high-gravity solids each has a particle size distribution wherein 90% or more of the particles are anywhere in the range of 0.1 micrometer to 500 micrometers.

14. The method according to claim 1, wherein the one or more high-gravity solids comprise barite.

15. The method according to claim 1, wherein the one or more low-gravity solids each has a density greater than the density of the continuous oil phase as measured under standard laboratory conditions.

16. The method according to claim 1, wherein the one or more low-gravity solids each has a particle size distribution wherein 90% or more of the particles are anywhere in the range of 0.1 micrometer to 500 micrometers.

17. The method according to claim 1, wherein the step of determining or the step of predicting is performed with the aid of a computer device.

18. The method according to claim 1, further comprising the step of circulating the fluid in the well at a fluid circulation rate of less than 100 ft/min.

19. The method according to claim 1, further comprising the step of circulating the fluid in the well at a circulation rate of less than 100 ft/min or with a drill pipe rotation speed less than 100 RPM anywhere in the wellbore for at least 1 hour.

20. The method according to claim 1, wherein the well bore inclination is in the range of 20° to 60° to the horizontal.

21. The method according to claim 11, wherein the water-soluble salt is an inorganic salt.

* * * * *